United States Patent [19]

Van Krevelen

[11] 4,098,509

[45] Jul. 4, 1978

[54] GOLFING DEVICE

[76] Inventor: Nellis D. Van Krevelen, 1932 Jefferson St., Muskegon, Mich. 49441

[21] Appl. No.: 804,583

[22] Filed: Jun. 8, 1977

[51] Int. Cl.[2] ..... A63B 69/36; G08B 3/00

[52] U.S. Cl. ..... 273/183 B; 46/175 R; 116/67 R; 116/148; 116/120

[58] Field of Search ..... 116/170, 67 R, 120, 116/148, 35 R, 35 A; 273/183 B, 190 R, 190 A; 46/174, 175 R

[56] References Cited

U.S. PATENT DOCUMENTS

| | | | |
|---|---|---|---|
| 1,386,545 | 8/1921 | Worgan | 46/174 |
| 2,561,743 | 7/1951 | Kusnarowis | 116/148 X |
| 2,585,075 | 2/1952 | Badovinac | 35/29 |
| 2,702,521 | 2/1955 | Earl et al. | 46/174 |
| 2,949,612 | 8/1960 | Kafko et al. | 116/67 R X |
| 2,974,439 | 3/1961 | Fawick | 46/175 R X |
| 3,156,211 | 11/1964 | Mallory | 273/190 A |
| 3,814,048 | 6/1974 | Bartholomew | 116/67 R |
| 3,906,478 | 9/1975 | Smey | 340/279 |

*Primary Examiner*—George J. Marlo

*Attorney, Agent, or Firm*—Price, Heneveld, Huizenga & Cooper

[57] ABSTRACT

A golfing device for audibly indicating improper head movement of a golfer during a golf swing. A support is clamped to a golfer's hat, a headband or the like and movably secures a sound-producing element adjacent the golfer's head. Any head movement beyond a predetermined, slight amount in generally any direction will cause the sound-producing device to audibly signal the golfer. In the preferred embodiment, a pivotally mounted bell is adjusted to accommodate the stance of the particular golfer using the device so that the bell striker is out of contact with the bell interior prior to a swing.

18 Claims, 9 Drawing Figures

GOLFING DEVICE

BACKGROUND OF THE INVENTION

This invention relates to golfing aids or accessories and, more particularly, to a golfing device for use in practicing a golf swing for audibly indicating improper head movement during such a swing.

Proper contact with a golf ball when swinging a golf club requires substantial immobility of the golfer's head. Improper head movement will cause the golfer to lift his shoulders and arms, or otherwise prematurely or improperly move portions of his body, preventing the club face from striking the ball squarely. Many golfers, and especially those who play infrequently, must repeatedly practice their golf swing while concentrating on maintaining head immobility. Since the golfer must coordinate other body movements while maintaining head immobility, it becomes difficult for all but highly experienced golfers to determine when his or her head is or is not maintained substantially motionless.

Numerous devices have been devised in the past to indicate to a golfer when his head is moved improperly during a golf swing. Typically, such prior structures have includes a ball within a tube or other container which is somehow attached to the golfer's head. Contact members are positioned at the ends of the tube or container such that if the head is moved, the ball strikes the contact members producing an audible signal. A critical drawback of these prior structures is that they do not signal the golfer if his head is moved in other than a predetermined direction. Thus, if the tube or container is positioned substantially horizontally, lateral but not vertical head movements are indicated. Conversely, a vertically or angularly positioned tube would indicate vertical or angular movement but not movement in other directions.

Other indicators have included one or more mercury switches which may be secured at various parts of the golfer's body, such as on either shoulder and/or the back of the head, to close electrical circuitry and operate a buzzer providing an audible sound upon improper head movement. These mercury switch devices are extremely complicated and expensive to manufacture and use. More importantly, the mercury switch devices and the rolling ball-container type devices are difficult to properly position so that different golfers' stances may be properly accomodated.

Also, certain prior structures have included visible wires adapted to protrude into the golfer's line of sight to the ball such that he will maintain his head in a position to continue to view the device and the wire throughout the golfer swing. These vision-type devices are difficult for a golfer to use because the required attention on the visible object detracts from his ability to coordinate movements of other portions of his body to produce an accurate swing.

In addition, many of the above-mentioned structures have been difficult or awkward to secure to the golfer's head or have required involved structure to do so.

SUMMARY OF THE INVENTION

Accordingly, the present invention provides a golfing device for audibly indicating improper head movement of a golfer during a golf swing. The device is designed to be clamped or otherwise secured to a golfer's hat, a headband or the like and includes a bell or other audible sound-producing element support adjacent the golfer's head. The sound-producing unit is secured such that it may be moved or adjusted to accommodate the stance of each different golfer using the device to a nonsignal producing position at the beginning of his swing. Any head movement beyond a predetermined, slight amount after the swing is begun, in generally any direction, will cause the sound-producing element to audibly signal the golfer in a manner which avoids extreme concentration on or over emphasis of the head position.

In one embodiment of the invention, the device includes attachment means for attaching the device to an item of clothing worn on the head such as a hat, headband or the like. Support means are included extending from the attachment means for supporting an audible signal-producing means. The audible signal producing means produces a sound audible to the human ear upon movement in generally any direction when the device is attached to a golfer's head and the golfer's head is moved beyond a predetermined amount during a golf swing. A securing means movably secures the signal-producing means to the support means such that it is adjustable to a nonsignal-producing position as the golfer assumes his or her stance and addresses the golf ball preparatory to swinging.

In a preferred embodiment of the invention, the audible signal-producing means is a bell including a universally pivotable strikes therewithin. The bell is suspended from a support arm which is attached to or extends from a clamp designed for attachment to a golfer's hat, a headband or the like. The bell may be adjustably positioned prior to swinging for each different golfer's stance such that the striker is out of contact with the inside interior of the bell. Any head movement beyond the distance between the bell striker and the bell interior will produce a signal audible to the golfer.

The present invention is extremely simple to manufacture and operate. It overcomes prior known problems with head movement signaling devices because it is extremely easily adjusted to accommodate the stances of different golfers. Moreover, it allows slight, unproblematic head movement without producing a signal. Louder signals are produced with faster or greater head movements. The overall device is evenly balanced and supports the audible signal-producing element without being obtrusive or distractive to the golfer. Most importantly, the device will indicate improper head movement in virtually any direction in which the golfer's head is moved and not merely in one or two directions.

These and other objects, advantages, purposes and features of the invention will become more apparent from a study of the following description taken in conjunction with the drawings.

DESCRIPTION OF THE PREFERRED EMBODIMENTS

Figure 1:
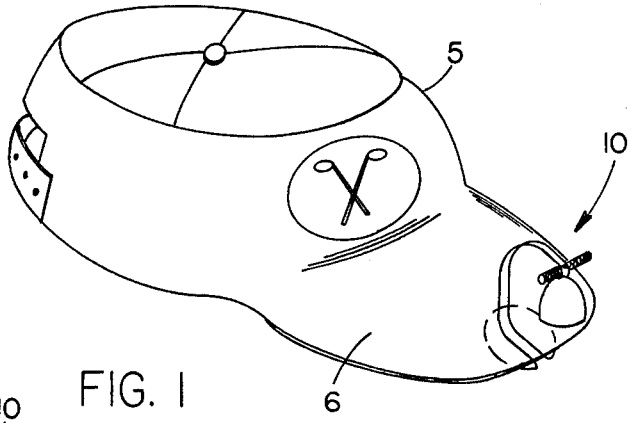
FIG. 1 is a perspective view of a typical golfer's hat or cap including the golfing device of the present invention clamped to the bill of the hat in position for use.
Figure 2:
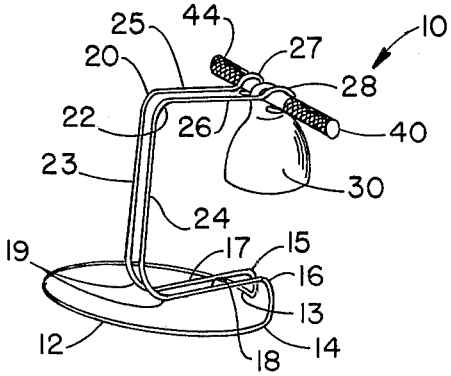
FIG. 2 is a perspective view of one embodiment of the golfing device of the present invention.
Figure 9:
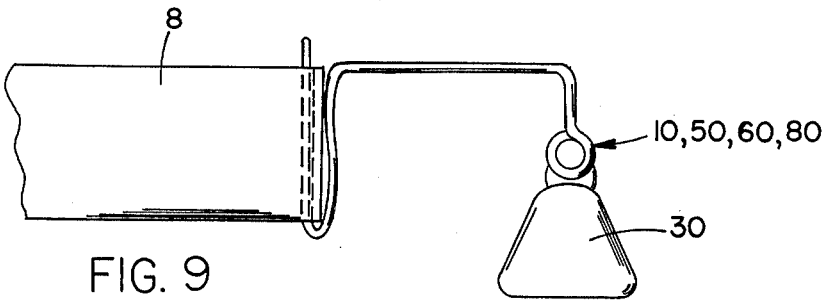
FIG. 9 is a side elevation of an alternate support arrangement for the golfing device of the present invention wherein it is clamped to a headband.

Referring now to the drawings in greater detail, FIG. 1 illustrates a first embodiment 10 of the golfing device of the present invention shown attached to a golfer's hat or cap 5 having a bill 6 extending forwardly. Signaling device 10 is desired for attachment to the front edge of the bill for easy accessibility by the golfer for adjustment of the bell or other audible signal-positioning device included thereon to his or her particular stance when he or she addresses the ball before swinging. Alternately, as shown in FIG. 9, the invention may be clamped or otherwise secured to a headband 8 such that it is suspended outwardly from the forehead area of a golfer.

Embodiment 10 of the golfing, signal-producing device includes a clamp-type attachment base 12, a pair of support arms 20, 22 extending outwardly and upwardly from the base, and a bell 30 or other audible signal-producing element pivotally secured at the ends of the support arms. Base 12 is a circular, substantially closed loop member formed from a resilient, bent wire. The wire is preferably heat treated after formation to make it resilient or springy, and to retain it in its desired shape. At portions 13, 14 of the loop which are adjacent one another at the front, wire portions 15, 16 extend upwardly and out of the general plane in which the loop 12 is formed. Portions 15, 16 curve back toward the plane of the loop 12 along rectilinear clamping or pressure portions 17, 18 which are parallel to one another. Sections 17, 18 end in portions 19, the bottom portions of which are substantially at or in the plane of loop 12. The resiliency of the bent wire, from which the portions 12–19 are formed, provides a spring biasing or clamping force when portions 17, 18 are moved away from the loop portion 12 for insertion of the bill of a hat or other material therebetween. When released, portions 19 and portions of loop 12 securely clamp the bill of the hat or headband therebetween to secure the device 10 in its desired location.

Support arms 20, 22 are continuations of the single length of bent wire forming the loop member and pressure or clamping members 17, 18 described above. Arms 20, 22 are generally L-shaped having their longer legs 23, 24 generally perpendicular to the plane of the loop 12 while their shorter legs 25, 26 are generally parallel to the plane of that loop. The length of shorter arms 25, 26 provides adjustment clearance for bell 30, as described below. Since wire portions 17, 18, which form the pressure members or clamping members, extend beyond the center of the circular loop and closer to one side thereof, shorter legs 25, 26 of the support arm extend back in the direction of portions 15, 16 of the base and terminate over and in general alignment with the loop base 12. This provides secure, stable, balanced support for the audible sound-producing device over the base so that the device is not uncomfortable for the golfer when attached to his hat or a headband. The terminal or free ends of support arms 20, 22 include small circular loops 27, 28 bent from the same wire as the arm. The support arms and the loops 27, 28 are parallel to one another but spaced apart providing room for insertion of the support flange from the bell 30 for clamping and pivotal support.

Bell 30 is a small, tapered, generally conical, hollow bell having an open bottom 32 and an upper, top support flange 34. Flange 34 includes an aperture extending therethrough generally parallel to the plane of the bottom of the bell. Supported within the hollow interior of the bell, from a downwardly extending flange 36, is a universally pivotable bell strikes 38. The striker includes a steel ball or mass at its lower end which is approximately four to five times smaller than the diameter of the bell housing. The striker itself may pivot universally around flange 36 and strike any portion of the circumference of the interior surface of the bell housing.

Figure 3:
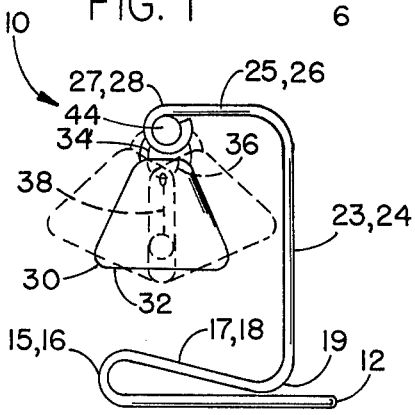
FIG. 3 is a side elevation of the golfing device shown in FIGS. 1 and 2 and illustrating various positions to which the bell-sounding device may be adjusted.
Figure 4:
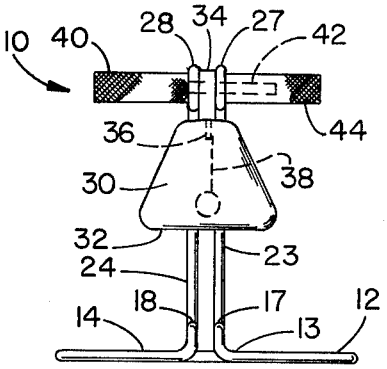
FIG. 4 is a front elevation of the golfing device embodiment shown in FIGS. 1–3.
Figure 5:
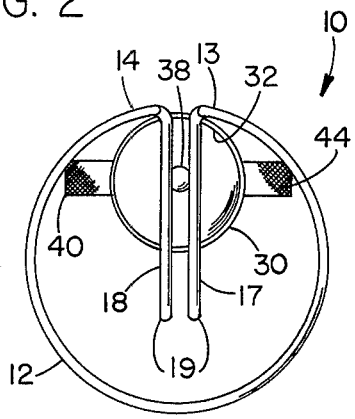
FIG. 5 is a bottom view of the golfing device shown in FIGS. 1–4.

Bell 30 is preferably pivotally secured between support arms 20, 22 and particularly terminal loop ends 27, 28 by insertion of its flange 34 therebetween. A pivot axle is inserted through the loops and the aperture in the bell flange 34 to secure it in position. Preferably, the pivot axle includes a thumb screw member 40 having a threaded, rod-like extension 42 which is passed through the loops 27, 28 and the bell flange aperture. A corresponding thumb screw member or abutment 44 having a threaded, female bore in one end surface thereof is threaded over extension 42 to retain the bell on the axle and between the loops. Members 42, 44 are tightened together with their inner end surfaces contacting the outer sides of loops 27, 28 to clamp the bell flange 34 securely between the loop members. This pivotal attachment allows the bell to be pivoted forwardly and rearwardly as shown in FIG. 3 such that the striker 38 is out of contact with the interior surface of the bell when the golfer assumes his proper stance adjacent the golf ball before swinging. Lateral movement of the device to accommodate the golfer's stance is accomplished by turning the entire apparatus on the bill of the hat or headband if necessary. Alternately, the wire itself can be bent slightly to properly position the bell. When so positioned, movement of the golfer's head during a swing more than just a slight amount will cause striker 38 to strike the interior of the bell producing an audible signal indicating to the golfer than his head has been moved improperly. The smaller size of the striker than the interior of the bell, however, will accommodate slight head movements without producing an audible signal. Such slight movements, which are insufficient to cause improper contact of the club face with the ball during a golf swing, need not be indicated to the golfer. Head movement in virtually and direction—up, down, sideways, or angularly—will produce an audible sound because the striker 38 is univerally pivotable. Also, quicker and stronger head movement will produce a louder sound because the striker 38 will hit the interior of the bell with a greater force. Slight head movements which are sufficient to cause the striker to only lightly hit the interior of the bell will produce barely audible sounds. Hence, the degree and severity of head movement are determinable with the present invention which may be adjusted to virtually any stance assumed by a golfer prior to his swinging.

Figure 6:
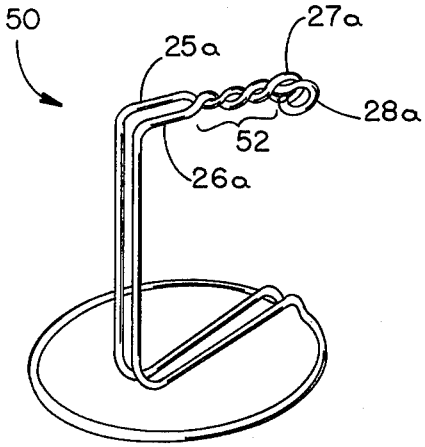
FIG. 6 is a perspective view of the attachment and support portion of a second embodiment of the golfing device.

As shown in FIG. 6, a modified or second embodiment 50 of the golfing device is shown. Embodiment 50 is substantially identical to embodiment 10 described above except for the shorter arm portions 25*a*, 26*a*. These support arm portions are twisted together in area 52 as illustrated to facilitate clamping pressure by terminal loop end portions 27*a*, 28*a* against the bell flange which pivotally supports bell 30. This provides greater pressure on the bell to more securely hold it in position after adjustment.

Figure 7:
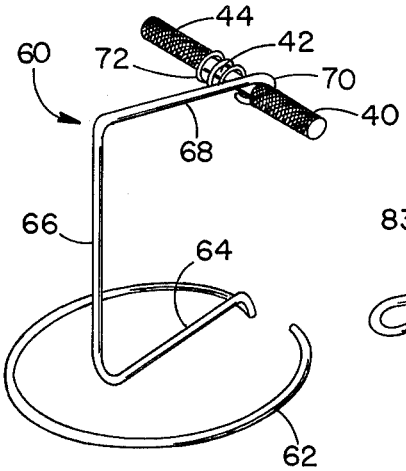
FIG. 7 is a perspective view of the attachment and support portion of a third embodiment of the golfing device.

Another embodiment 60 of the present golfing device is shown in FIG. 7. Device 60 is similar to embodiments 10 and 50 except that it includes but a single pressure or clamping arm 64 curving back toward the plane of clamping loop 62. Pressure arm 64 curves upwardly into a single, L-shaped support arm including a longer vertical portion 66 and a shorter horizontal portion 68 which is parallel to the loop base 62. The support arm ends in a single loop terminal 70 through which is passed the extension portion 42 of thumb screw member 40 received in thumb screw member 44. However, intermediate the end surface of thumb screw member 44 and one side of the terminal loop 70, a coil spring is telescopingly assembled over extension 42. Spring 72 provides a biasing force against the side of the bell flange 34 which urges it against the side of loop 70 when the bell is pivotally supported on extension 42. Spring 72 eliminates the need to loosen and tighten thumb screw members 40, 44 each time the position of the bell 30 requires a change. Bell 30 may be pivotally adjusted while the biasing force of spring 72 retains the bell in any position after adjustment even without further tightening of members 40, 44.

Figure 8:
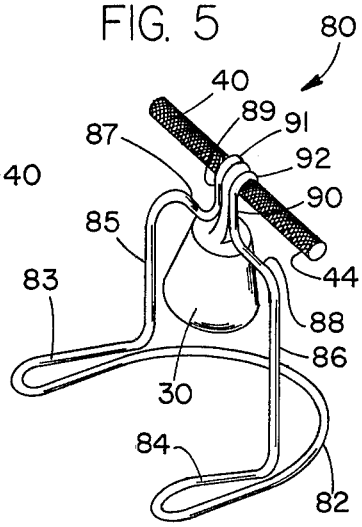
FIG. 8 is a perspective view of a fourth embodiment of the golfing device.

Yet another embodiment 80 of the golfing device is shown in FIG. 8. Embodiment 80 includes a generally planar, semicircular loop member 82 having its wire ends curved or folded back upon themselves to form clamping or pressure members 83, 84 which curve back toward other portions of the semicircular loop 82. Clamp members 83, 84 extend continuously and curve upwardly into vertically extending support arms 85, 86 which curve into support arm portions 87, 88 over the middle of loop 82 and extend generally parallel to that loop. Arm portions 87, 88 curve vertically upwardly into shorter, vertical arm portions 89, 90 which terminate in loops 91, 92. In embodiment 80, bell 30 is supported between vertical arm portions 85, 86 with bell flange 34 being clampingly and pivotally secured between terminal loops 91, 92 with threaded thumb screw members 40, 44 passed through the terminal loops and the bell flange for support of the bell as in embodiments 10, 50 above. Embodiment 80 provides slightly greater stability for support of the bell by means of the spaced clamping arms 83, 84 while retaining overall balance by means of the central support of bell 30 between arms 85, 86.

Once the golfing signal device in any of its embodiments 10, 50, 60 or 80 is assembled as described above, it is used by clampingly attaching it to the front edge of the bill of a golfing hat or cap as shown in FIG. 1 or over the bottom edge of a headband 8 as shown in FIG. 9. The cap or headband is then placed on the head of the golfer who assumes his normal stance adjacent the golf ball when addressing that ball in preparation for swinging. Once the golfer has assumed his proper stance, he may easily reach up and grasp the pivotal bell 30 in any of the embodiments of the device and move it so that the striker 38 is out of contact with the interior surfaces of the bell housing. In certain cases, the base of the device including the clamping portion may have to be moved on the bill of the hat or the headband. If necessary, the thumb screw portions 40, 44 are loosened to move the bell and tightened when the bell has been brought to its proper position. Typically, especially with embodiment 60, including the biasing spring, such tightening and loosening will be unnecessary.

After the above adjustment, the golfer swings in normal fashion and any improper head movement beyond a slight amount allowed by the difference in size between the striker and the inside of the bell is audibly indicated to him or her by the sounding of the bell as the striker hits the side of the bell. As mentioned above, faster or stronger head movements are indicated by louder audible signals while slight movement sufficient only to cause the striker to brush against the inside of the bell are faint. The degree and severity of head movement by the golfer is thus immediately apparent during and after his swing. Repeated practice with the device will help to maintain the golfer's head motionless and to ensure proper golf shots.

Other audible signal-producing elements may be used with the device other than a hollow bell such as that shown at 30 herein. Any sound-producing signaling device which will provide a signal upon movement thereof in generally any direction, and can be adjusted to a nonsignal-producing position prior to swinging, will be sufficient as long as it can be supported properly. The bell as shown herein has been found preferable, however, because of its simplicity, universal signaling ability and ease in support and adjustment.

Also, other supports could be used without deviating from the spirit of the invention as long as overall adjustability of the audible signal-producing device is maintained. For instance, bell 30 could be supported from a support by a ball joint structure making the entire bell universally adjustable with respect to the support. Also, the resilient wire forming the support could be formed into any other configuration which would adequately support the bell or audible signal-producing device.

While several forms of the invention have been shown and described, other forms will now be apparent to those skilled in the art. Therefore, it will be understood that the embodiments shown in the drawings and described above are merely for illustrative purposes and are not intended to limit the scope of the invention which is defined by the claims which follow.

The embodiments of the invention in which an exclusive property or privilege is claimed are defined as follows.

1. A golfing device for audibly indicating improper head movement of a golfer during a golf swing comprising attachment means for attaching the device to an item of clothing worn on the head such as a hat, headboard or the like; support means extending from said attachment means for supporting an audible signal-producing means; an audible signal-producing means for producing a sound audible to the human ear upon movement in generally any direction when the device is attached to a golfer's head and the golfer's head is moved beyond a predetermined amount during a golf swing; and securing means for movably securing said audible signal-producing means to said support means whereby said signal-producing means is adjustable to a nonsignal-producing position as the golfer assumes his or her stance and addresses the golf ball preparatory to swinging.

2. The golfing device of claim 1 wherein said audible signal-producing means include a bell having a universally pivotal striker therein; said securing means including pivot means for pivotally securing said bell to one end of said support means with its striker suspended downwardly.

3. The golfing device of claim 2 wherein said bell has a predetermined interior circumference, said striker being smaller than that interior circumference whereby slight movement of said bell can occur without said striker hitting the bell interior and without an audible sound being produced.

4. The golfing device of claim 2 wherein said support means includes an arm terminating at a position spaced from said attaching means; said bell having an upstanding flange with an aperture therethrough, said pivot means including a pivot axle secured to said arm at said position and passing through said bell flange aperture to pivotally support said bell thereon and retaining means for retaining said bell on said pivot axle.

5. The golfing device of claim 4 wherein said pivot axle is threaded; said retaining means including an abutment threaded on said pivot axle.

6. The golfing device of claim 5 wherein said retaining means include a spring intermediate said abutment and said bell flange, said spring urging said bell flange against at least a portion of said arm and allowing pivotal movement of said bell to adjust its position but providing a biasing force to hold said bell in the desired position after adjustment.

7. The golfing device of claim 1 wherein said attachment means is a clamping member having a loop member formed from a length of resilient bent wire and lying at least partially in one plane, said loop member including at least one pressure member formed from a continuation of the bent wire forming said loop, said pressure member extending outwardly of said loop away from said one plane and curving back toward said one plane whereby matter inserted between said loop and pressure member will be securely clamped therebetween.

8. The golfing device of claim 7 wherein said support means includes at least one support arm formed in one piece with said loop member, said arm extending outwardly from said loop member to a position spaced from said loop member at which said securing means and audible sound-producing means are located.

9. The golfing device of claim 8 wherein said position on said arm is located in general alignment with said loop and pressure member such that said sound-producing means is supported in a stable, balanced position.

10. The golfing device of claim 8 wherein said support arm is L-shaped and terminates at a free end aligned over said loop and pressure members.

11. The golfing device of claim 8 including a pair of said pressure members and a pair of said support arms, each arm terminating in a free end positioned in general alignment with said attachment means, said free arm ends being adjacent one another with said sound-producing device secured therebetween by said securing means.

12. The golfing device of claim 11 wherein said support arms are parallel to one another and are twisted together in engagement with one another immediately adjacent said free ends to facilitate securement of said sound-producing means between said free ends.

13. The golfing device of claim 1 wherein said attachment means is a clamp adapted to be secured to the bill of a golfer's cap, a headband or the like; said support means including an arm extending outwardly of said clamp to a position spaced from said clamp and supporting said sound-producing device and securing means at said position.

14. A golfing device for audibly indicating improper head movement of a golfer during a golf swing comprising a support; a clamp at one end of said support for attaching said device to a golfer's hat, a headband or the like; a bell having a universally pivotable striker therein for producing a sound signal audible to the human ear upon a predetermined amount of movement of the golfer's head in generally any direction during a golf swing; and securing means for movably attaching said bell to said support whereby said bell is movable to various positions to accommodate the stance of the golfer using the device as he or she addresses the golf ball preparatory to swinging a golf club to strike the ball such that said striker will be out of contact with said bell interior prior to swinging the club but will be moved pivotally to strike the bell interior upon a predetermined amount of head movement in generally any direction during the swing.

15. The golfing device of claim 14 wherein said support includes at least one L-shaped arm terminating in a free end with said bell being pivotally supported by said pivotal securing means at said free end.

16. The golfing device of claim 14 wherein said support includes a pair of L-shaped arms with said bell pivotally secured between at least portions of said arms.

17. The golfing device of claim 14 wherein said clamp is a loop member formed from a continuous, resilient bent wire and lying at least partially in one plane, said loop member including at least one pressure member formed from a continuation of the bent wire forming said loop, said pressure member extending outwardly of said loop away from said one plane and curving back toward said one plane whereby matter inserted between said loop and pressure member will be securely clamped therebetween; said support including at least one support arm formed in one piece with said loop member and extending outwardly thereof to a position spaced from said loop member where said bell is pivotally supported.

18. The golfing device of claim 14 wherein said securing means include a pivot axle for pivotally supporting said bell, retaining means for retaining said bell on said axle, and biasing means intermediate said retaining means and bell for biasing said bell toward said support.

* * * * *

UNITED STATES PATENT AND TRADEMARK OFFICE

CERTIFICATE OF CORRECTION

PATENT NO. : 4,098,509

DATED : July 4, 1978

INVENTOR(S) : Nellis D. Van Krevelen

It is certified that error appears in the above-identified patent and that said Letters Patent are hereby corrected as shown below:

Column 1, line 25:
"includes" should be -- included --

Column 1, line 53:
"golfer" should be -- golf--

Column 2, line 28:
"strikes" should be -- striker --

Column 4, line 15:
"strikes" should be -- striker --

UNITED STATES PATENT AND TRADEMARK OFFICE

CERTIFICATE OF CORRECTION

PATENT NO. : 4,098,509
DATED : July 4, 1978
INVENTOR(S) : Nellis D. Van Krevelen It is certified that error appears in the above-identified patent and that said Letters Patent are hereby corrected as shown below:

Column 4, line 49:
"than" should be -- that --

Column 4, line 56:
"and" should be -- any --

Column 6, lines 55 and 56:
"headboard" should be -- headband --

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*